US007588467B2

(12) United States Patent
Chang

(10) Patent No.: US 7,588,467 B2
(45) Date of Patent: Sep. 15, 2009

(54) ELECTRICAL CARD CONNECTOR

(75) Inventor: Wei-Cheng Chang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/998,089

(22) Filed: Nov. 28, 2007

(65) Prior Publication Data

US 2008/0124979 A1 May 29, 2008

(30) Foreign Application Priority Data

Nov. 28, 2006 (TW) ..... 095220946

(51) Int. Cl.
*H01R 24/00* (2006.01)

(52) U.S. Cl. ..... 439/630; 439/607; 439/377

(58) Field of Classification Search ..... 439/603, 439/607, 377, 159

See application file for complete search history.

(56) References Cited

U.S. PATENT DOCUMENTS 6,969,282 B2 11/2005 Liu
6,976,864 B1 12/2005 Huang
7,303,442 B2 * 12/2007 Fan ..... 439/630
7,442,044 B2 * 10/2008 Yang et al. ..... 439/64
2003/0157839 A1 * 8/2003 Yamaguchi et al. ..... 439/630
2003/0216082 A1 * 11/2003 Sato et al. ..... 439/630
2005/0037668 A1 * 2/2005 Yu ..... 439/630
2005/0282440 A1 * 12/2005 Tseng et al. ..... 439/630
2006/0128225 A1 * 6/2006 Matsumoto et al. ..... 439/630
2006/0172603 A1 * 8/2006 Matsumoto et al. ..... 439/630
2006/0194478 A1 * 8/2006 Ting ..... 439/630
2007/0059983 A1 * 3/2007 Anzai et al. ..... 439/630
2008/0254659 A1 * 10/2008 Ting ..... 439/159

* cited by examiner

*Primary Examiner*—Gary F. Paumen
(74) *Attorney, Agent, or Firm*—Wei Te Chung

(57) ABSTRACT

An electrical card connector includes an insulating housing (2), a shell (1) mounted on the insulating housing, a plurality of terminals (3). The insulating housing includes a plurality of terminal rooms (23) arranged in two rows along a card inserting direction and a middle part (24) defined between the two rows of terminal rooms. The terminals retained in corresponding terminal rooms of the insulating housing. The shell mounted over the insulating housing to define a card slot, the shell comprising a main body (11), the main body having an embossment (112) protruding into the card slot for engaging with the card, the embossment being situated rightly above the middle part of the insulating housing to press on an inserted card and to distance other portion of the main body from the card.

11 Claims, 4 Drawing Sheets

4

ELECTRICAL CARD CONNECTOR

BACKGROUND OF THE INVENTION

1. Field of the Invention

The present invention relates to an electrical card connector, and more particularly to an electrical card connector capable of preventing a card from being damaged.

2. Description of Prior Arts

With the development of the technology of electronics, more and more mini-type electronic equipments turn up, such as PDA, digital cameras, music players, and so on. Accordingly, many kinds of memory cards for storing information of mini-type electronic equipments are appearing.

Generally, a memory card as mentioned above connects with the electronic equipment by an electrical card connector placed in the electronic equipment. The memory card includes a contact or terminal array for connecting electrically with the electrical card connector. Accordingly, the electrical card connector primarily includes a number of terminals for electrically engaging with corresponding contacts of the card, an insulating housing for retaining the terminals, and a metal shell mounted on the insulating housing. In many prior art shells, spiculate or sharp edges are present. When a card is inserted, the spiculate edge of the metal shell would contact with the card directly and may damage the card. So, it is an object of the present invention to solve the above described problem.

SUMMARY OF THE INVENTION

An object, therefore, of the invention is to provide an electrical connector which forms a plurality of embossments engaging with a card for preventing a card from broken.

In the exemplary embodiment of the invention, an electrical card connector includes an insulating housing, a shell mounted on the insulating housing, a plurality of terminals. The insulating housing includes a plurality of terminal rooms arranged in two rows along a card inserting direction and a middle part defined between the two rows of terminal rooms. The terminals retained in corresponding terminal rooms of the insulating housing. The shell mounted over the insulating housing to define a card slot, the shell comprising a main body, the main body having an embossment protruding into the card slot for engaging with the card, the embossment being situated rightly above the middle part of the insulating housing to press on an inserted card and to distance other portion of the main body from the card.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
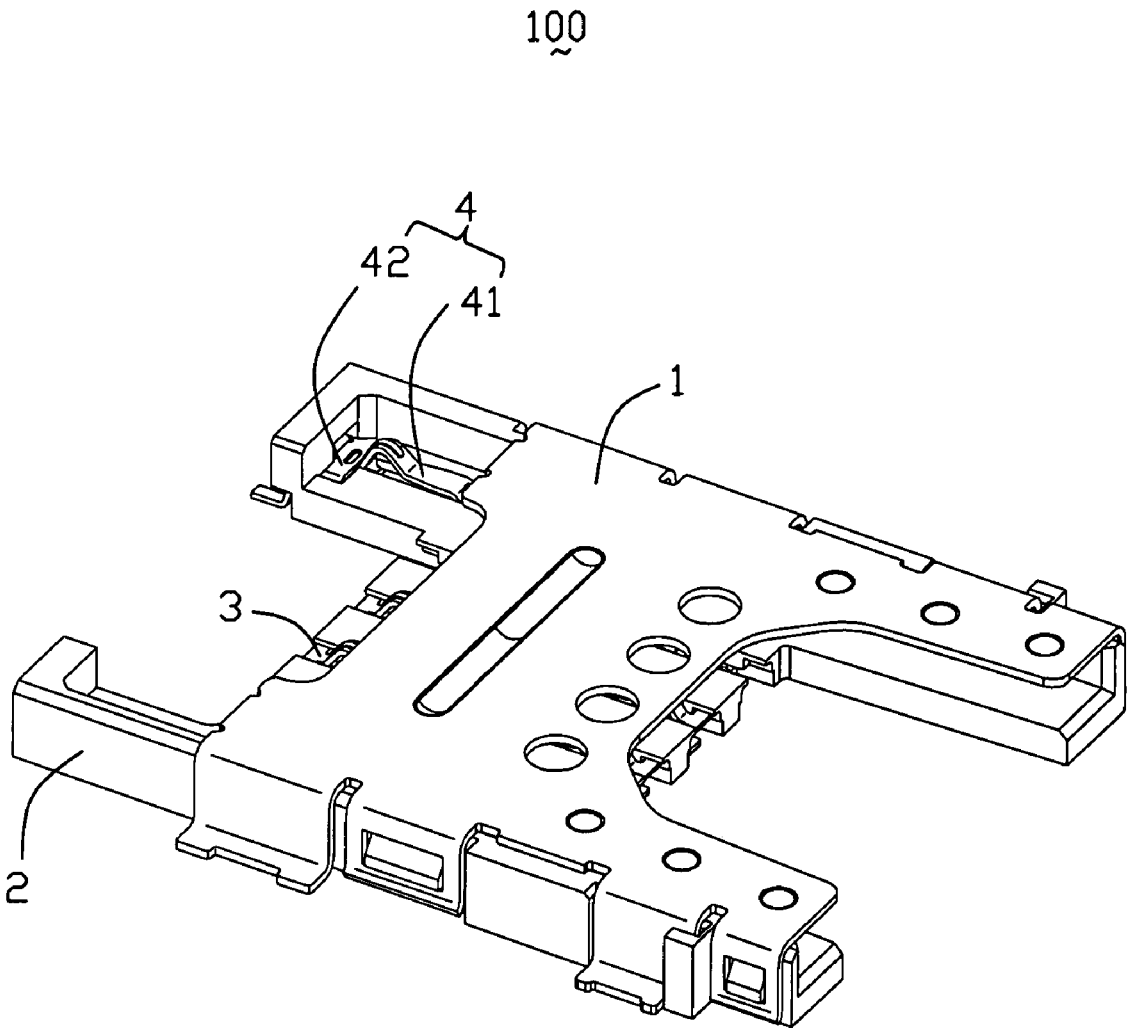
FIG. 1 is a perspective, assembly view of an electrical card connector of the present invention.
Figure 2:
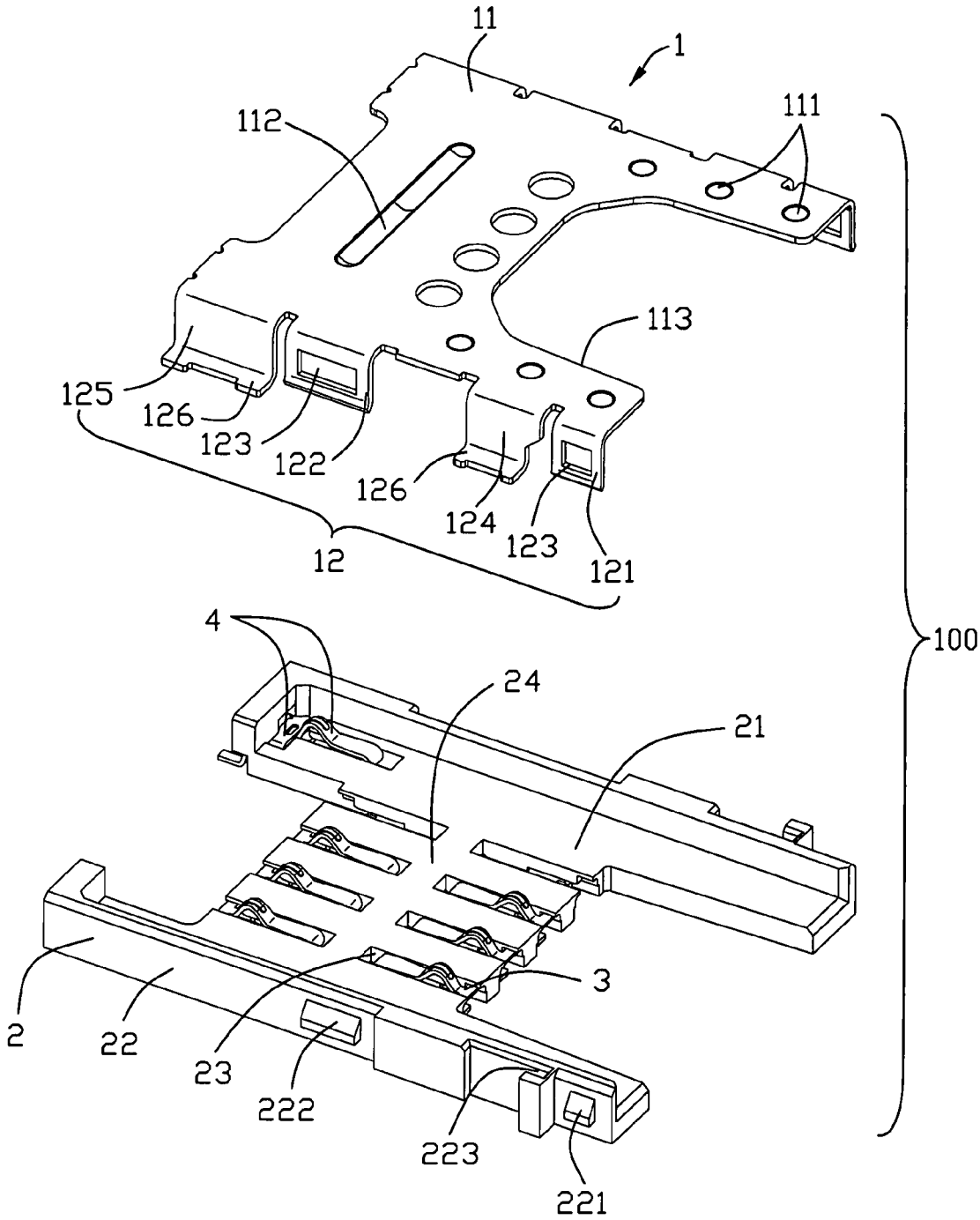
FIG. 2 is a perspective view of a shell and an insulating housing retaining a plurality of terminals.
Figure 3:
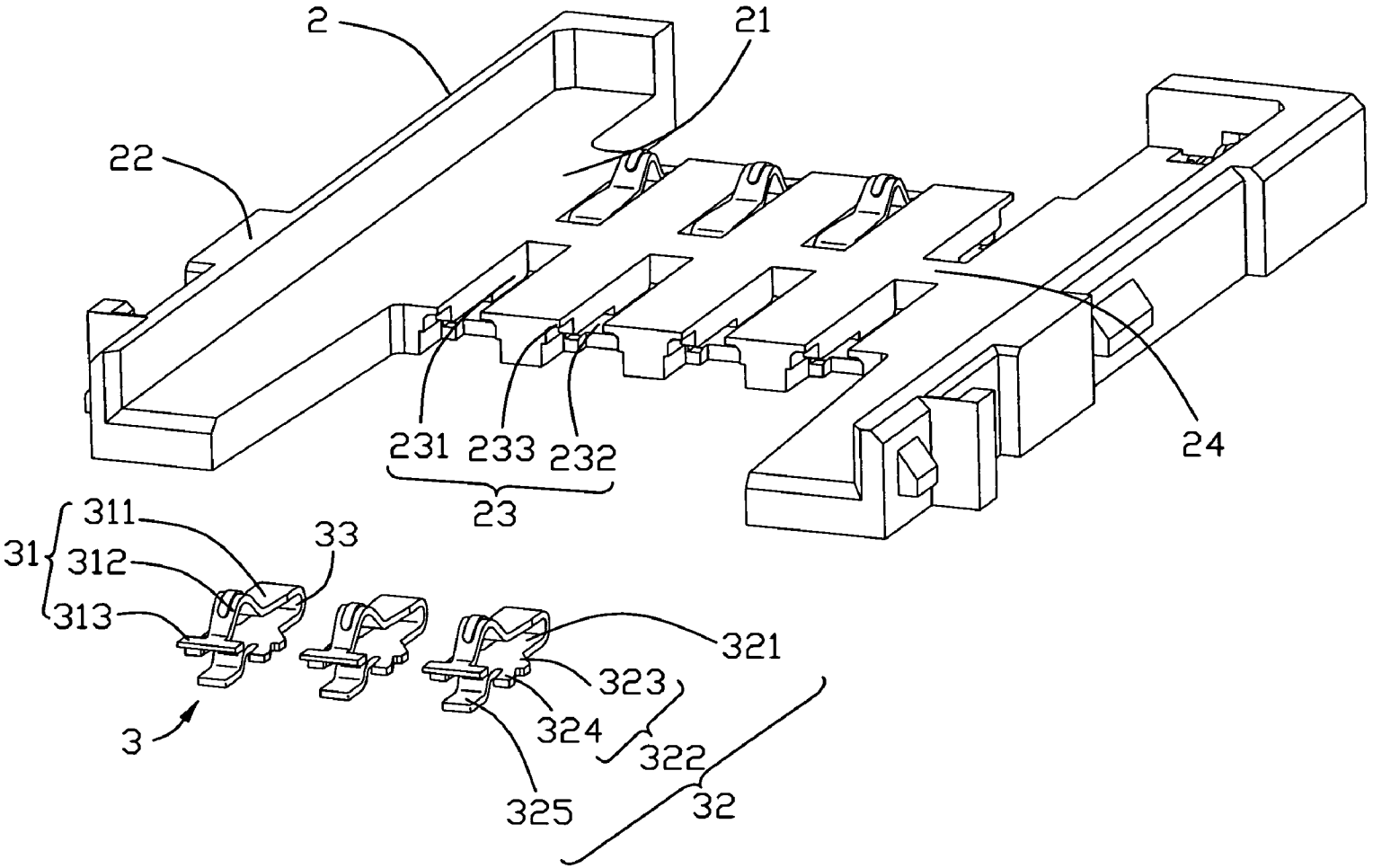
FIG. 3 is a perspective view of the insulating housing and the terminals.

As shown in FIG. 1 to FIG. 3, an electrical card connector in accordance with the present invention comprises an insulating housing 2, a metal shell 1 mounted on the insulating housing 2, a plurality of terminals 3 retained in the insulating housing 2, a card slot (not labeled) defined by the insulating housing 2 and the shell 1, and a switch member 4 retained in the insulating housing 2.

As shown in FIG. 3, each terminal 3, structured as a U shape, includes an upper portion 31, a lower portion 32 and an U-shaped elastic portion 33 joining the upper portion 31 with the lower portion 32 together. The upper portion 31 has a body section 311, an engaging section 312 protruding upwardly from the body section 311 and a tail section 313 extending horizontally and forwardly from the engaging section 312. The width of the tail section 313 is wider than that of the engaging section 312. Further more, the engaging section 312 protruding higher than the body section 311 comes to connect with a card more reliably. Correspondingly, the lower portion 32 has a nether body section 321, a fixing section 322 extending outwardly from the lateral sides of the nether body section 321, and a soldering section 325 tending downwardly and extending forwardly from a head of the nether body section 321. Regarding to the fixing section 322, it includes an elastic locking portion 324 and a situated device 323 located at a rear end of the locking portion 324.

Referring to FIG. 2 and FIG. 3, the insulating housing 2 has a body plate 21 and a pair of lateral walls 22 opposite to each other extending upwardly from the body plate 21. The body plate 21 includes a plurality of terminal rooms 23 arranged in two rows along the card insertion direction, so a middle part 24 is formed therebetween. Each terminal room 23 includes a receiving channel 231, and a locking channel 232 expanding laterally from the receiving channel 231. The width of the locking channel 232 is accordance with that of the fixing section 322 of the terminals 3. At the rear end of the receiving channel 231, a stopping portion 233 is formed.

Each lateral wall 22 of the insulating housing 2 comprises a first clasping tab 221, a second clasping tab 222 and a first fastening channel 223. The first fastening channel 223 extends in an up-to-down direction and is placed between the first clasping tab 221 and the second clasping tab 222.

As shown in FIG. 1 and FIG. 2, the metal shell 1 and the insulating housing 2 define a card inserting opening (not labeled). The metal shell 1 comprises a main body 11 and a plurality of side walls 12 extending downwardly from the main body 11. A recess 113 is defined at the head of the main body 11 allowing the card to be operated conveniently. The main body 11 has a plurality of first circle embossments 111 and second embossments 112 resembling a lath, each embossment protruding downwardly into the card slot. Substantially, the first embossment 111 and the second embossment 112 can be other configuration. The first embossments 111 are arranged in two rows at the lateral sides of the recess 113 in a card insertion direction, and the second embossment 112 is opposite to the recess 113. At a front of the second embossment 112, a row of testing holes (not labeled) are defined for testing whether the terminals are operating or not, the testing holes arranged in a transverse direction. Combining with the first embossments 111, the recess 113 is surrounded by the testing holes and the first embossments 111.

Each side wall 12 comprises a plurality of first clasping parts 121, second clasping parts 122, first fastening parts 124 and second fastening parts 125. Each clasping part 121 and 122 defines a clasping hole 123, and each fastening part 124 and 125 defines a tending foot 126 extending horizontally and outwardly for soldering the electrical card connector 100 on a Printed Circuit Board (PCB).

Figure 4:
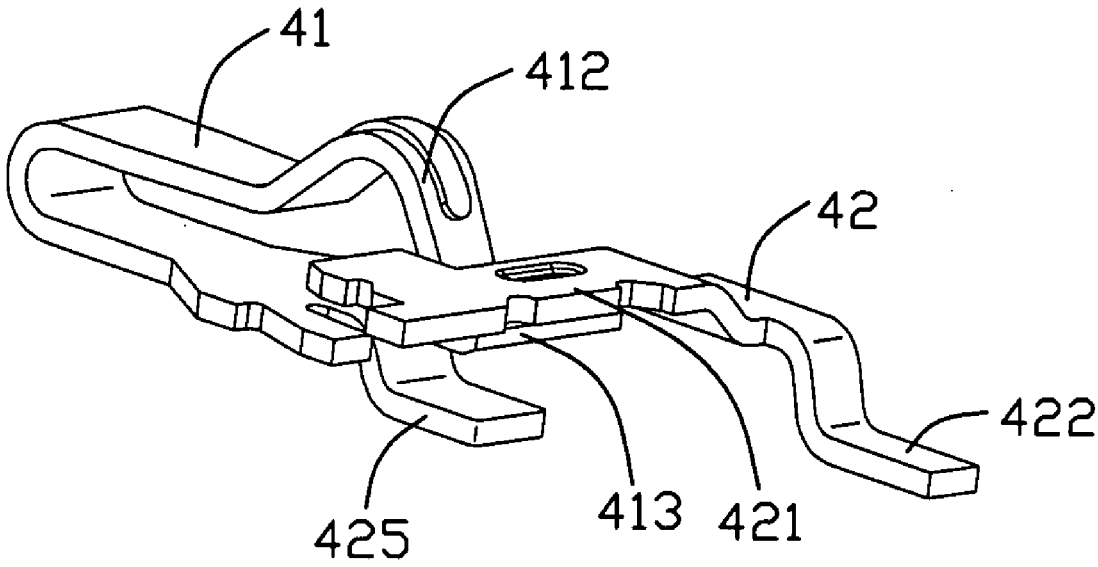
FIG. 4 is a perspective view of one terminal shown in FIG. 3.

As shown in FIG. 1 and FIG. 4, a switch member 4 comprises a first switch member 41 and a second switch member 42 partially located on the first switch member 41. The structure of the first switch member 41 is the same as that of the U-shaped terminals 3. Accordingly, the first switch member 41 is formed with an engaging section 412, a tail section 413 and a soldering section 425. So the first switch member 41 and the terminals 3 can be made of in a same way to save cost. The second switch member 42 has a colliding port 421 engaging with the trail section 413 and a soldering foot 422 for soldering with a cable. The switch member 4 is in a close state when the card is rejected. On the contrary, when the card is inserted, the engaging section 412 of the switch member 4 is pressed by the card, correspondingly, the trail section 413 detaching with the colliding port 421 of the second switch member 42. Then the switch 4 is unclosed.

Going with the FIG. 1 to FIG. 4, the relationship of the elements as said above of the electrical card connector 100 is to be described in following segments. Firstly, the terminals 3 are retained in corresponding terminal rooms 23 of the insulating housing 2, with each body section 311 and nether body section 321 located in corresponding receiving channel 231, each fixing section 322 retained in corresponding locking channel 232 in an interference way, each elastic locking portion 324 retained in corresponding locking channel 232 elastically so that the terminals 3 retained in the insulating housing 2 stably, and the tail section 313 colliding with the stopping portion 233 for preventing the upper portion 31 from flipping beyond.

Finally, the shell 1 is mounted on the insulating housing 2 by each clasping hole 123 mating with corresponding first clasping tab 221 and second clasping tab 222 of the insulating housing 2. Then the second embossment 112 is directly above the middle part 24 of the insulating housing 2 for pressing and preventing the card from inclining, achieving a believable connection between the card and the terminals 3. When a card is inserted, the first embossments 111 and the second embossment 112 press on the card, then the upper surface of card is separated with the inner surface of the main body 11 of the metal shell 1. In another word, the card insertion or ejection is safe and escaping from being damaged by the sharp edge of the metal shell 1. Besides, one row terminals 3 are located under the testing holes rightly for a convenient operation of the terminals 3.

In this invention, the insulating housing 2 is covered by the shell 1 partially. In other embodiments, if an insulating housing is covered by a shell fully, it is necessary to form a third embossment (not shown) opposite to the second embossment 112 of this invention, besides the second embossment 112 and the third embossment are rightly above corresponding row terminals 3 for pressing on a card and preventing one end of the card from cocking, making sure that the terminals and the card could connect with each other stablely.

As described above, an advancement of the electrical card connector is primly in the following segment: the card is inserted in such way that the inner surface of the main body 11 of the shell 1 is separated with the upper surface of the card, because the first embossment 111 projecting into the receiving room and pressing on the card. This structure allows the card go through the spiculate edge of the shell 1 safely. Besides, the second embossment 112 is located directly opposite to the middle part of the insulating housing 1 and adapted for pressing on the card, achieving a believable connection between the card and the terminals 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical card connector comprising:

an insulating housing comprising a plurality of terminal rooms arranged in two rows and each row being perpendicular to the card inserting direction, and a middle part defined between the two rows of terminal rooms;

a plurality of terminals retained in corresponding terminal rooms of the insulating housing; and a shell mounted over the insulating housing to define a card slot, the shell comprising a main body, the main body having a plurality of embossments arranged near the card insert opening in two columns parallel to the card inserting direction and another embossment perpendicular to the card inserting direction and protruded into the card slot for engaging with the card, the another embossment being situated rightly above the middle part of the insulating housing to press on an inserted card and to distance other portion of the main body from the card.

2. The electrical card connector as claimed in claim 1, wherein the main body of the shell and the embossment are unitary.

3. The electrical card connector as claimed in claim 1, wherein each terminal comprises a locking portion retained in the insulating housing.

4. The electrical card connector as claimed in claim 1, wherein each terminal is generally U-shaped.

5. The electrical card connector as claimed in claim 1, wherein each terminal room comprises a stopping portion, and each terminal comprises a tail section bearing against the stopping portion.

6. The electrical card connector as claimed in claim 1, wherein a switch member is mounted in the insulating housing.

7. The electrical card connector as claimed in claim 6, wherein the switch member comprises a first switch member and a second switch member for engaging with the first switch member.

8. The electrical card connector as claimed in claim 1, wherein a testing hole is defined on the main body, one row of the terminals located under the testing hole rightly.

9. The electrical card connector as claimed in claim 1, wherein a recess is defined at a front of the main body.

10. An electrical card connector comprising:

an insulative housing; and a metallic shell attached top of the housing, and cooperating with the housing to define a card receiving space, said shell defining an U-shaped configuration in a top view, said U-shaped configuration including a pair of side sections extending along two side arms of the housing, and a bridging section connecting said two side sections and located at a rear section of the housing; wherein a first set of embossments downward formed on said two side sections and extending into the card receiving space; and a second set of embossments downwardly formed on said bridging section and extending into the card receiving section so as to stabilize Insertion of a card from beginning to end.

11. The electrical card connector as claimed in claim 10, wherein the housing defines an H-shaped configuration in said top view so as to allow said contacts to be assembled into the housing from two opposite directions.

* * * * *